US005148789A

United States Patent [19]

Shiraishi et al.

[11] Patent Number: 5,148,789

[45] Date of Patent: Sep. 22, 1992

[54] GOVERNOR DEVICE OF DIESEL ENGINE

[75] Inventors: Yasunori Shiraishi; Masahiro Nagahama; Mutsumi Murata; Yuzo Umeda; Setsuo Yamada; Kazuyoshi Morioka, all of Sakai, Japan

[73] Assignee: Kubota Corporation, Osaka, Japan

[21] Appl. No.: 609,570

[22] Filed: Nov. 6, 1990

[30] Foreign Application Priority Data

Nov. 7, 1989 [JP] Japan ..... 1-290753
Dec. 19, 1989 [JP] Japan ..... 1-329211

[51] Int. Cl.[5] ..... F02D 31/00

[52] U.S. Cl. ..... 123/367; 123/370; 123/365

[58] Field of Search ..... 123/370, 373, 365, 374, 123/357, 358, 359, 379, 382, 383, 396, 367

[56] References Cited

U.S. PATENT DOCUMENTS

| | | | |
|---|---|---|---|
| 2,195,927 | 4/1940 | Hurst et al. | 123/357 |
| 3,871,344 | 3/1975 | Pigeroulet et al. | 123/358 |
| 4,212,279 | 7/1980 | Ohtani | 123/357 |
| 4,355,609 | 10/1982 | Skinner | 123/373 |
| 4,377,994 | 3/1983 | Lang | 123/357 |
| 4,497,294 | 2/1985 | Izumi et al. | 123/357 |
| 4,566,417 | 1/1986 | Suzuki et al. | 123/357 |
| 4,567,870 | 2/1986 | Tumber | 123/370 |
| 4,569,319 | 2/1986 | Thoma | 123/357 |
| 4,572,132 | 2/1986 | Piwonka | 123/359 |
| 4,576,130 | 3/1986 | Hafele et al. | 123/357 |
| 4,589,392 | 5/1986 | Wirz | 123/359 |
| 4,656,980 | 4/1987 | Ohkoshi | 123/373 |
| 4,706,627 | 11/1987 | Eltze et al. | 123/370 |
| 4,736,721 | 4/1988 | Asami | 123/373 |
| 4,757,791 | 7/1988 | Hachitani et al. | 123/357 |
| 4,782,804 | 11/1988 | Lehmann | 123/365 |
| 4,831,984 | 5/1989 | Takahashi | 123/373 |
| 4,836,165 | 6/1989 | Kubota et al. | 123/357 |
| 4,884,542 | 12/1989 | Konrath et al. | 123/365 |

FOREIGN PATENT DOCUMENTS

| | | | |
|---|---|---|---|
| 0012049 | 1/1979 | Japan | 123/370 |
| 0173342 | 9/1985 | Japan | 123/357 |
| 62-82345 | 5/1987 | Japan . | |
| 0953238 | 8/1982 | U.S.S.R. | 123/370 |
| 1524674 | 9/1978 | United Kingdom | 123/370 |

*Primary Examiner*—E. Rollins Cross
*Assistant Examiner*—Thomas N. Moulis
*Attorney, Agent, or Firm*—Lowe, Price, Le Blanc & Becker

[57] ABSTRACT

In a governor device of a diesel engine, a control rack of a fuel injection pump is adapted to be controllably actuated by a balance between a governor spring and an engine revolution speed responsive means. A speed control member is adapted to be manipulated for adjusting a tension force of the governor spring. A fuel limiting actuation member serves to prevent an excessive fuel flow from being injected when the speed control member is manipulated for a quick acceleration. A quick acceleration state detecting means serves to detect a quickly accelerated state of the engine so as to selectively change over the fuel limiting actuation member to a fuel limiting position and to a fuel limitation cancelling position depending on the lapse of time.

6 Claims, 5 Drawing Sheets

GOVERNOR DEVICE OF DIESEL ENGINE

BACKGROUND OF THE INVENTION

1. Field of the Invention

The present invention relates to a governor device installed in a diesel engine, and more specifically to a governor device provided with a mechanical governor or a pneumatic governor.

2. Prior Art

Generally, the aforementioned governor device is constructed as follows. A control rack of a fuel injection pump is adapted to be operatively controlled through a governor lever in accordance with a balance between a resilient force exerted to a fuel increasing side by a governor spring and a governor force exerted to a fuel decreasing side by an actuation member such as a governor weight and the like. Thereby, though a load of a diesel engine changes, an engine revolution speed can be maintained at a predetermined value.

As such governor device, there has been known the one provided with two levers as a governor lever as disclosed in Japanese Utility Model Laid Open Publication No. 1987-82345. This prior art was filed by an assignee of the present invention and is constructed as follows.

That is, the governor lever comprises a fork lever to be engaged with the control rack and a spring lever actuated by a tension force of the governor spring. The spring lever is adapted to be received by a fuel limiting pin at the full load position, and the fork lever is adapted to be resiliently urged to the fuel increasing side by a starting spring.

Since the aforementioned double-lever type governor device is capable of moving the control rack to a starting fuel increasing position by the starting spring through the fork lever, advantageously the engine can be readily started. There is, however, such a problem associated therewith, as black smoke is generated at the time of a quick acceleration of the engine.

That is, when an acceleration lever and the like are quickly operated for a quick acceleration, the tension force of the governor spring is promptly increased. But, since there exists a time lag in an increase of the engine revolution speed, a balance between the governor force and the tension force of the spring is broken and then the spring lever and the fork lever are quickly swung to the fuel increasing side. Since the swing is quick, the fork lever is further swung to the fuel increasing side by both its inertial force and the tension force of the starting spring and to make the control rack overrun to the starting fuel increasing position even after the spring lever has been received by the fuel limiting pin. Thereby, a fuel injection quantity of the fuel injection pump becomes excessive to generate black smoke.

Further, the problem of the smoke generated at the quick accelerating operation was caused also in a single-lever type governor device of a diesel engine with a turbocharger.

That is, similarly to the above, the tension force of the governor spring is promptly increased by the quick accelerating operation of the acceleration lever and the like. But, there exists a time lag in the increase of the engine revolution speed as well as there also exists a time lag in an increase of a boost pressure of the turbocharger. Therefore, an excessive fuel is supplied relative to a less intake air to generate black smoke.

SUMMARY OF THE INVENTION

It is an object of the present invention to restrain a generation of black smoke even in the case that a diesel engine is quickly accelerated.

For accomplishing the aforementioned object, according to the present invention, a governor device is provided with a fuel limiting actuation member and a quick acceleration state detecting means. The fuel limiting actuation member serves to prevent a fuel from being excessively supplied when a speed control member is manipulated for a quick acceleration. The quick acceleration state detection means serves to detect the state that the diesel engine has been quickly accelerated as well as to hold the fuel limiting actuation member at a fuel limiting position during the lapse of time required at least since the engine is quickly accelerated and to change over the fuel limiting actuation member to a fuel limitation canceling position after the lapse of time.

According to the above-mentioned construction, the following advantages can be provided.

When the diesel engine is operatively accelerated from its low revolution speed range, as mentioned above, a balance between the governor force and the tension force of the governor spring is broken and the control rack is apt to quickly shift to the fuel increasing side. Thereupon, the shifting farther than a predetermined distance is prevented for the required time by the fuel limiting actuation member changed over to the fuel limiting position. As a result, an excessive fuel is prevented from being injected into a combustion chamber of the diesel engine within the required time to restrain the generation of black smoke.

Further, after the lapse of the aforementioned time, since the fuel limiting actuation member is changed over to the fuel limitation cancelling position, the control rack is allowed to shift to the fuel increasing side. But, at that time, the engine revolution speed has increased so that the governor force has become sufficiently large, and also the boost pressure has sufficiently increased even in the case of the engine with the turbocharger. Accordingly, even after the lapse of the required time, the fuel injection quantity can be prevented from becoming excessive, so that the generation of the black smoke can be restrained.

Further, in the above-mentioned construction, if said quick acceleration state detecting means is adapted to detect the quick acceleration state in the low revolution speed range and thereby limit the fuel within the term of a required time, it is unnecessary to limit the fuel in the high revolution speed range where black smoke is generated in a small amount, and as a result engine response can be improved in the high revolution speed range.

BRIEF DESCRIPTION OF THE DRAWINGS

FIG. 1 is a vertical sectional front view of a governor device;

FIG. 2 is a front view of a speed control member of the governor device;

FIG. 3 is a sectional view taken along the III—III directed line in FIG. 2;

FIG. 4 is an explanatory view of an operation of the governor device at the time of an engine start;

FIG. 5 is an explanatory view of the operation of the governor device under a low speed operating condition of the engine;

FIGS. 6(A) and 6(B) show chageover conditions of a fuel limiting actuation member, FIG. 6(A) is a view showing a change of a target speed set by the speed control member relative to the lapse of time, and FIG. 6(B) is a view showing a change of an actuation position of the fuel limiting actuation member relative to the lapse of time;

FIG. 7 is a partial view corresponding to FIG. 1; and

FIGS. 8(A) and 8(B) are views corresponding to FIGS. 6(A) and 6(B)

DESCRIPTION OF THE PREFERRED EMBODIMENTS

First Embodiment

FIGS. 1, 2, 3, 4, 5, 6(A) and 6(B) show a first embodiment of the present invention.

Firstly, the whole construction thereof will be explained with reference to FIGS. 1 through 3.

Figure 1:
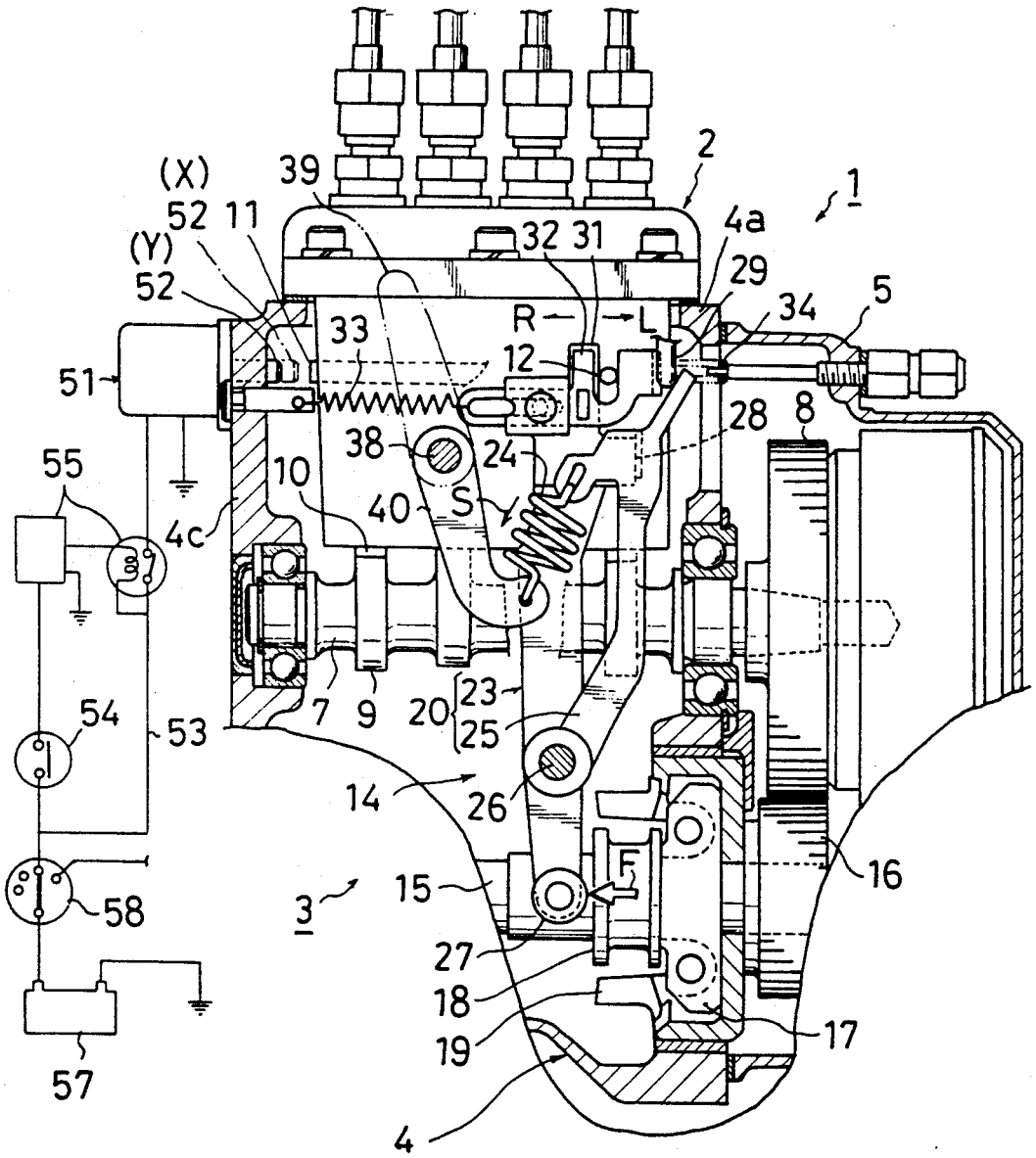
FIGS. 1, 2, 3, 4, 5, 6(A) and 6(B) show a first embodiment of the present invention.

As shown in FIG. 1, a diesel engine 1 has a pump housing 4 provided with a fuel injection pump 2 and a mechanical governor device 3. A gear case 5 is fixedly secured to the right side of the pump housing 4.

The fuel injection pump 2 is inserted into the pump housing 4 from above the upper wall 4*a* of the pump housing 4 and fixedly secured to the upper wall 4*a*. A fuel injection camshaft 7 is rotatably supported by the pump housing 4 below the pump 2. A fuel injection cam gear 8 is fixedly secured to the right end of the camshaft 7. This cam gear 8 is interlockingly connected to a crankshaft (not illustrated). Four cams 9 mounted onto the camshaft 7 are brought into contact with respective pump element input portions 10 of the pump 2. A control rack 11 is internally fitted in the halfway height portion of the pump 2 so as to be shiftable in the right and left direction. A rack pin 12 is projected from the right portion of the control rack 11. In figures, the symbol R designates a fuel increasing side, and the symbol L does a fuel decreasing side.

A mechanical governor 14 of the governor device 3 is constructed as follows.

A governor shaft 15 is rotatably supported below the fuel injection camshaft 7 by the pump housing 4. A governor gear 16 fixedly secured to the right end of the governor shaft 15 is intermeshed with the cam gear 8. To the governor shaft 15, a weight holder 17 is fixedly secured and a governor sleeve 18 is externally fitted so as to be slidable in the right and left direction. A governor weight 19 serves as an engine speed detecting means is supported by the weight holder 17 so as to be centrifugally swingable. The centrifugal force acting on the governor weight 19 varies as the engine speed changes and is transmitted to a rack pin 12 through the governor sleeve 18 and a governor lever 20 in order.

The governor lever 20 comprises a fork lever 23 engaged with the rack pin 12 and a spring lever 25 connected to the right end portion of a governor spring 24. The fork lever 23 and the spring lever 25 are swingably supported at their lower portions by the pump housing 4 through a lever pivot 26. A governor force F via the governor sleeve 18 acts on an input roller 27 disposed at the lower portion of the fork lever 23. The fork lever 23 and the spring lever 25 are interlocked by a torque spring 28 (refer to FIGS. 4 and 5). The control rack 11 is resiliently urged to the fuel increasing side R by the tension force S of the governor spring 24 through the spring lever 25 and the fork lever 23 in order. In the contrary direction the control rack 11 is resiliently urged to the fuel decreasing side L by the governor force F through the fork lever 23. When the engine speed changes, as engine load varies, the control rack 11 controls the fuel injection quantity of the fuel injection pump 2 in accordance with the balance between the spring tension force S and the governor force F so that the engine revolution speed can be returned to a set revolution speed.

A fuel limiting pin 29 is fixedly secured to the upper wall 4*a* of the pump housing 4. The spring lever 25 is received by the fuel limiting pin 29 at a full load position B (refer to FIG. 4 or FIG. 5) and further restrained from moving to the fuel increasing side R.

The fork lever 23 comprises a vertically elongated lever body 31 and a thrust arm 32 horizontally slidably disposed at the upper portion of the lever body 31. The pin 12 of the control rack 11 is held between the upper portion of the lever body 31 and the right portion of the thrust arm 32 without any fitting gap. Thereby, a reactivity from the governor lever 20 to the rack pin 12 is increased. Between the left portion of the thrust arm 32 and a housing left wall 4*c* there is mounted a starting spring 33 for resiliently urging the control rack 11 to the fuel increasing side R. Further, between the right portion of the thrust arm 32 and the gear case 5 there is mounted an idle limit spring 34 for preventing the control rack 11 from moving to a fuel non-injection position.

For setting the engine revolution speed, there is provided a means for adjusting the tension force S of the governor spring 24. This means will be explained with reference to FIGS. 1 through 3.

Figure 2:
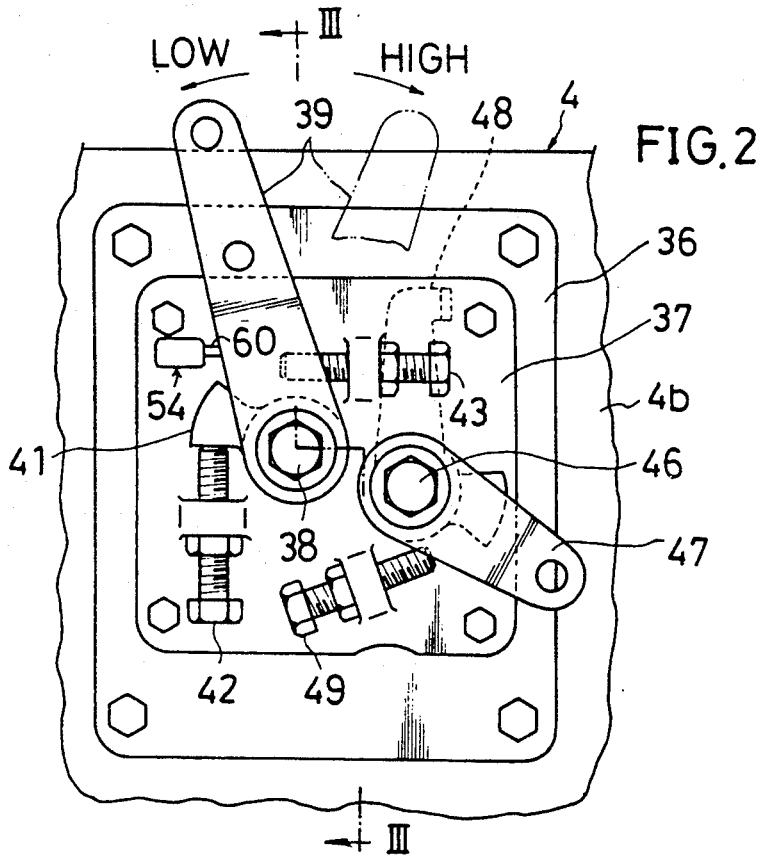
Figure 3:
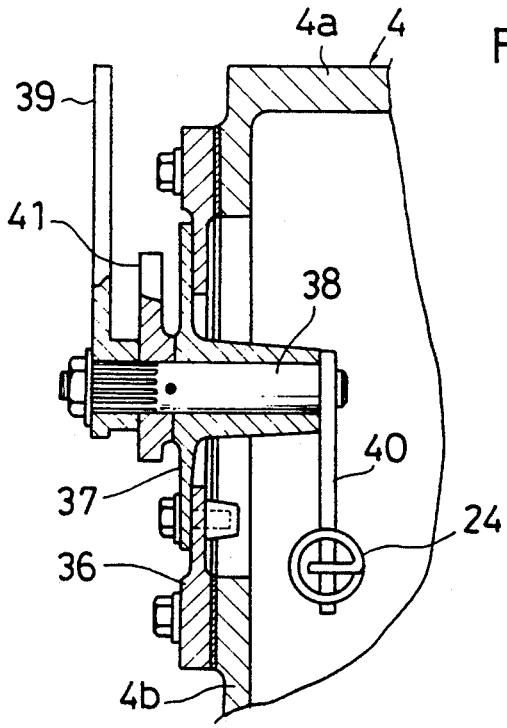

As shown mainly in FIGS. 2 and 3, an inside cover plate 36 and an outside cover plate 37 are attached to a front wall 4*b* of the pump housing 4 in order, and a pin 38 is rotatably supported by the outside cover plate 37. A speed control member 39 is fixedly secured to the outer end portion of the pin 38, and a speed control arm 40 is fixedly secured to the inner end portion of the pin 38. The speed control member 39 is adapted to be manipulated within a swing-angular extent defined by a low speed limit bolt 42 and a high speed limit bolt 43, through a revolution limiting arm 41 fixedly secured to the pin 38. The lower portion of the speed control arm 40 and the left upper swinging portion of the spring lever 25 are connected by the governor spring 24.

An engine stop lever 47 is fixedly secured to the outer end portion of another pin 46 rotatably supported by the outside cover plate 37, and a stopping arm 48 is fixedly secured to the inner end portion of the pin 46. When the engine is stopped, the stop lever 47 is turned clockwise so that the rack pin 12 is forcedly moved to the fuel decreasing side L by the stopping arm 48 through the governor lever 20 and then the control rack 11 is changed over to a stop position E (refer to FIG. 4 or FIG. 5). Incidentally, the turning manipulation for the stop lever 47 is restrained by another limit bolt 49.

In the governor device 3 constructed as mentioned above, there is provided a means for preventing the fuel from being excessively supplied in the case that the speed control member 39 is manipulated for the quick acceleration.

That is, as shown in FIG. 1, a solenoid 51 as the fuel limitation actuating member is fixedly secured to the housing left wall 4*c*, and an actuation rod 52 of the solenoid 51 is opposed to the left end surface of the control rack 11. A limit switch 54 and an electronic timer 55 as the quick acceleration state detecting means are arranged in series in a feed circuit 53 for the solenoid 51. Incidentally, the symbol 57 designates a battery, and the symbol 58 designates an engine key switch. The limit switch 54, as shown in FIG. 2, is fixedly secured to the left upper portion of the outside cover plate 37. A contact 60 of the limit switch 54 is opposed to the base portion of the speed control member 39.

Under the condition that the speed control member 39 is manipulated to a low speed revolution range (for example, a low speed range not more than approximately 1200 rpm in the case that the engines rated revolution speed is 3000 rpm), the contact 60 is resiliently urged by the speed control member 39 so that the limit switch 54 is held in the opened circuit state (electrically non-communicated state, the same hereinafter). Thereby, the solenoid 51 is held in a electrically non-communicating state so that the actuation rod 52 is held in a fuel limitation cancelling position Y. To the contrary, in the case that the speed control member 39 is manipulated to a position beyond the low speed revolution range, the contact 60 is projected so that the limit switch 54 is changed over to the closed circuit state ( electrically communicating state, the same hereinafter). Thereby, electricity is fed to the solenoid 51 for a required time (for example, around from 0.5 sec. to 1.0 sec.) set by a timer 55 so that the actuation rod 52 is advanced to be changed over to the fuel limiting position X. After the lapse of the required time set by the timer 55, the solenoid 51 is returned to a electrically non-communicated state so that the actuation rod 52 is retreated to the fuel limitation cancelling position Y.

Figure 4:
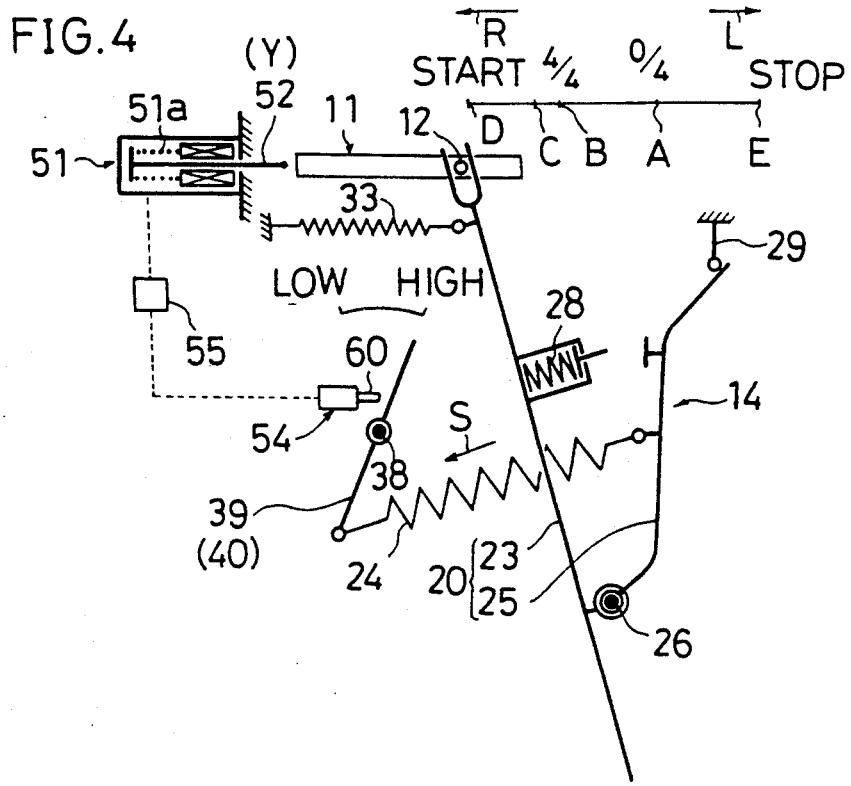
Figure 5:
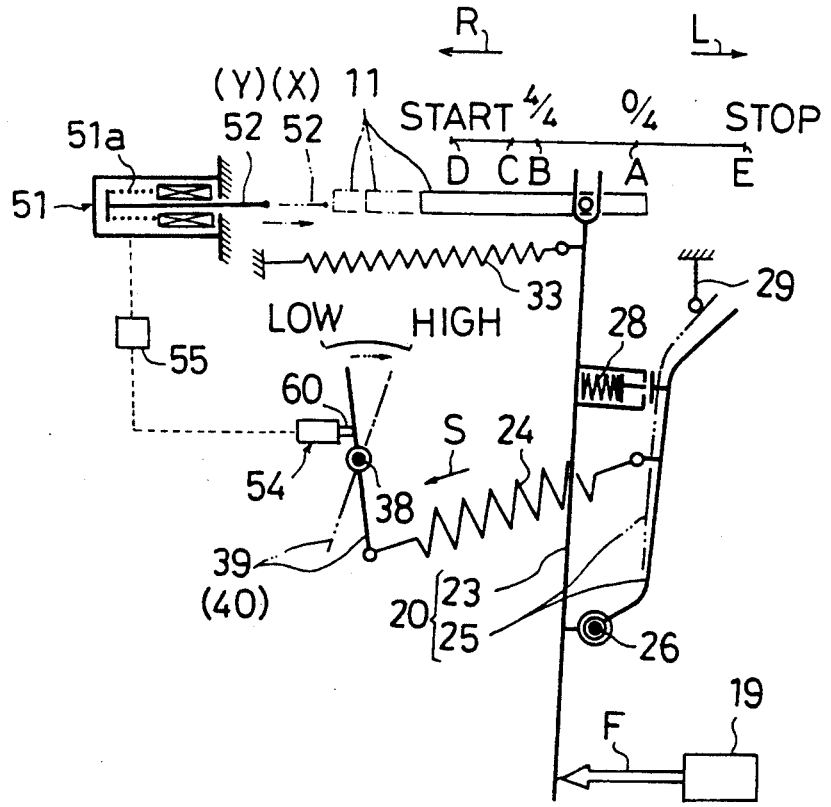
Figure 6A:
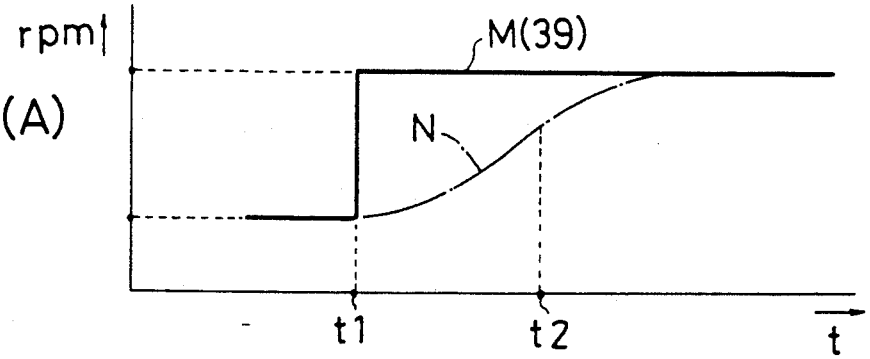
Figure 6B:
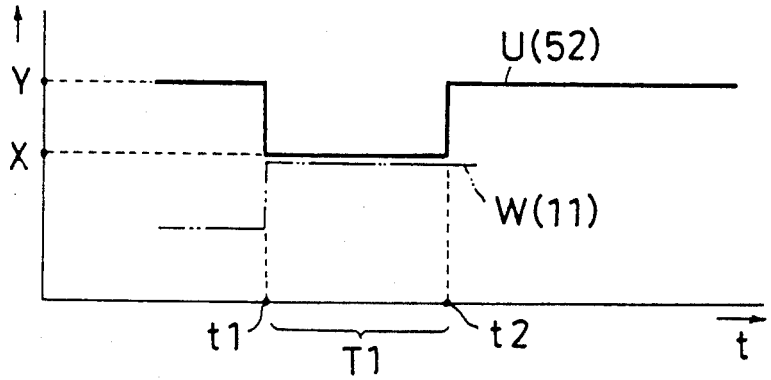

The operation of the governor device 3 will be explained with reference to FIGS. 4 through 6. FIGS. 4 and 5 are explanatory views of the operation thereof schematically showing FIG. 1 respectively. In FIG. 6(A), the solid line M indicates a change of a target engine revolution speed to be set by the speed control member 39, and the alternate long and short dash line N indicates a change of the actual revolution speed of the engine. In FIG. 6(B), the solid line U indicates a change of the position of the actuation rod 52 of the fuel limiting solenoid 51, and the alternate long and two short dashes line W indicates a change of the position of the left end surface of the control rack 11.

When the engine is started, as shown in FIG. 4, the speed control member 39 is manipulated to the starting position. Thereupon, the spring lever 25 is pulled to the fuel increasing side R by the governor spring 24 so as to be received by the fuel limiting pin 29 at the position corresponding to the full load position B. The fork lever 23 is further pulled by the starting spring 33 to the fuel increasing side R so as to move the control rack 11 to the starting position D via the torque-up position C. Though the limit switch 54 is in the closed circuit state, the timer 55 has already run down and the solenoid is in the electrically non-communicated state. Therefore, the actuation rod 52 is held at the fuel limitation cancelling position Y by a retreating spring 51*a* so that the control rack 11 is allowed to move leftward.

As shown in FIG. 5, at the time of the low speed operation of the engine, the speed control member 39 is manipulated to the low speed revolution range indicated by the solid line view. Under this low speed operating condition, the control rack 11 is controlled through the governor lever 20 in accordance with the balance between the tension force S of the governor spring 24 and the governor force F of the governor weight 19. By the way, in the case that an overload is imposed to the engine, the torque-up spring 28 serves to resiliently urge the fork lever 23 to the fuel increasing side R so as to make the engine running tenacious. Further, since the contact 60 of the limit switch 54 is adapted to be pushed and retreated by the speed control member 39, the limit switch 54 is held in the opened circuit state. Thereby, the solenoid 51 is held in the electrically non-communicated state, and the actuation rod 52 is at the fuel limitation cancelling position Y similarly to the above.

Then, when the speed control member 39 is manipulated for the quick acceleration from the aforementioned low speed revolution range (refer to the alternate long and two short dashes line in FIG. 5 and the time t1 in FIG. 6), the tension force S of the governor spring 24 promptly increases and to the contrary, the increase of the engine revolution speed is delayed. Therefore, the balance between the governor force F and the spring tension force S is broken, so that the spring lever 25 and the fork lever 23 are quickly swung to the fuel increasing side R. Since the swinging is quick, the fork lever 23 is further swung to the fuel increasing side R by the leftward inertial force and the tension force of the starting spring 33 even after the spring lever 25 has been received by the fuel limiting pin 29. Thereupon, the control rack 11 is forced so as to overrun to the left side outside the torque-up position C.

However, since the speed control member 39 gets out of the low speed revolution range and the limit switch 54 gets to the electrically communicated state prior to the leftward movement of the the control rack 11, the actuation rod 52 is changed over to the fuel limiting position X during the required time T1 (around from 0.5 sec. to 1.0 sec.) set by the timer 55. Therefore, the control rack 11 is prevented from overrunning to the fuel increasing side R beyond the torque-up position C during the required time T1. As a result, an excessive fuel injection into the combustion chamber of the engine is prevented and the generation of the black smoke can be restrained. After a time t2 past the required time T1, since the solenoid 51 is changed over to the electrically non-communicated state, the actuation rod 52 is changed over to the fuel limitation cancelling position Y to allow the control rack 11 to move to the fuel increasing side R. But, at that time, since the engine revolution speed has increased and the governor force F has become sufficiently large, it can be restrained that the fuel injection quantity becomes excessive.

Incidentally, the position for preventing the overrun of the control rack 11 by the actuation rod 52 may be set to the fuel decreasing side L beyond the torque-up position C or the full load position B.

Further, the aforementioned limit switch 54 may be disposed in a speed control transmission system from the governor spring 24 to an acceleration lever (not illustrated) via the speed control member 39. Accordingly, the limit switch 54 may be so disposed as to be opposed to the revolution limiting arm 41 interlocked to the speed control member 39, the speed control arm 40, and the acceleration lever and so on.

Furthermore, the quick acceleration state detecting means may be an acceleration detecting switch instead of the limit switch.

Instead of the fuel limiting solenoid 51 and the engine stop lever 47 being separately provided, the fuel limiting solenoid may comprise a double-acting solenoid so that the engine can be stopped by making use thereof.

Further, there may be provided a hydraulic cylinder adapted to be driven by means of a hydraulic pressure delivered from an engine lubrication oil feed pump, and the fuel limiting actuation member may comprise this hydraulic cylinder and a stop valve. Thereupon, the quick acceleration state detecting means may be composed of an engine revolution speed detecting means (for example, an intake negative pressure detecting means, an alternator voltage detecting means, a means for detecting a revolution speed of a ring gear connected to the crankshaft and the like). When the engine revolution speed exceeds the low speed revolution range, the hydraulic cylinder is advanced to the fuel limiting position by opening the stop valve depending on that detection signal. Incidentally, the aforementioned solenoid 51 may be so constructed as to be actuated by the engine revolution speed detecting means.

The governor device may comprise a pneumatic governor instead of the mechanical governor. In this case, the engine revolution speed detecting means is composed of a diaphragm type cylinder to be actuated by the intake negative pressure instead of the governor weight.

Figure 8A:
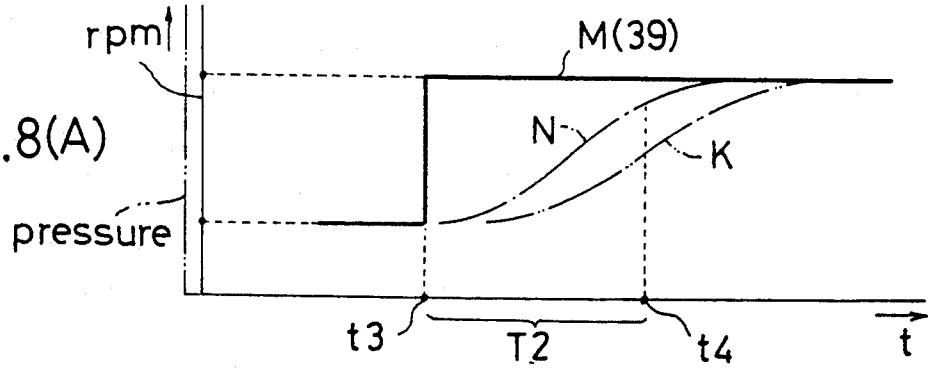
FIGS. 7 and 8(A) and 8(B) show a second embodiment of the present invention.
Figure 8B:
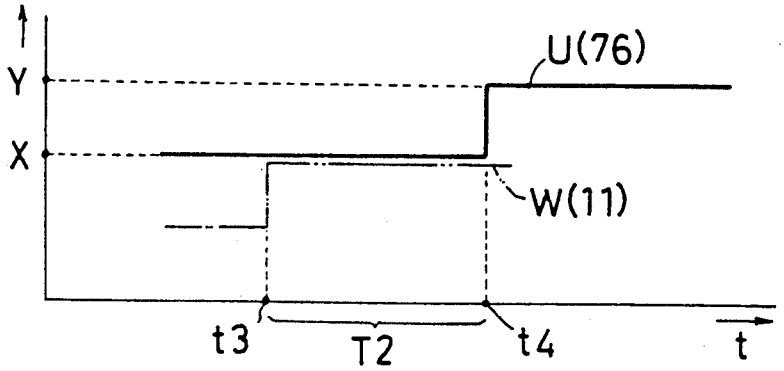
Figure 7:
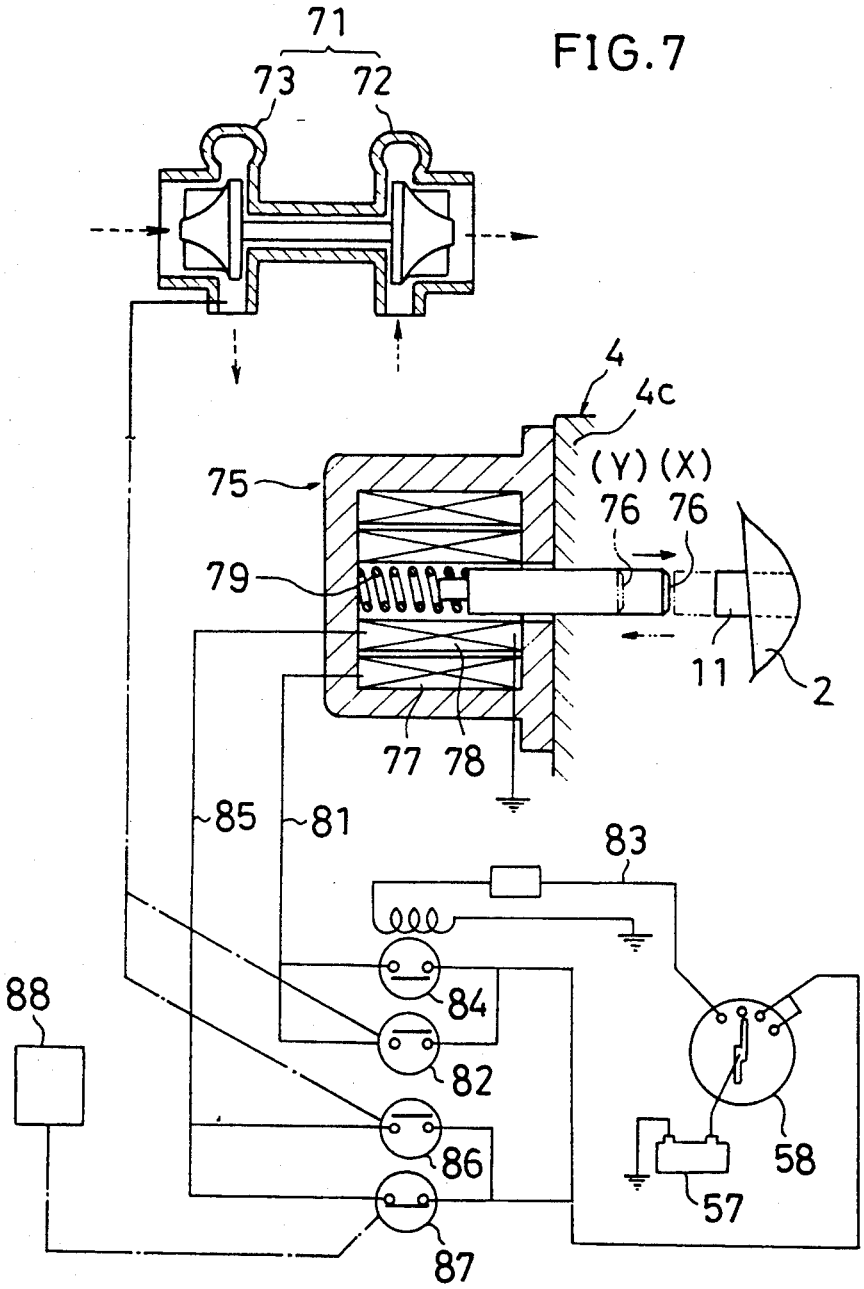

FIGS. 7 and 8 show a second embodiment of the present invention. In this embodiment, component members having the same construction as those in the above-mentioned first embodiment are designated by the same symbols.

As shown in FIG. 7, a diesel engine is equipped with a turbocharger 71 comprising an exhaust turbine 72 and a compressor 73. A solenoid 75 as the fuel limiting actuation member is fixedly secured to the left wall 4c of the pump housing 4. An actuation rod 76 of the solenoid 75 is so disposed as to be opposed to the left end surface of the control rack 11 of the fuel injection pump 2. This solenoid 75 comprises an absorbing coil 77 and a retaining coil 78 disposed internally and externally respectively. By holding both these coils 77, 78 in an electrically non-communicating state, the actuation rod 76 is changed over to the fuel limiting position X by an advancement spring 79. To the contrary, by feeding electricity to both these coils 77, 78, the actuation rod 76 is caused to retreat against the advancement spring 79 to be changed over to the limitation cancelling position Y.

In a feed circuit 81 of the absorbing coil 77, there are provided in parallel a first pressure switch 82 which operates by a boost pressure of the compressor 73 and a relay 84 which operates by detecting an electrically communicated state of a glow circuit 83. In a feed circuit 85 of the retaining coil 78, there are provided in parallel a second pressure switch 86 which operates by the boost pressure of the compressor 73 and a temperature switch 87 which operates by detecting a temperature of an engine cooling liquid. The symbol 88 designates a temperature detecting means. The respective pressure switches 82, 86 are put in opened circuits (off) in the case that the boost pressure of the compressor 73 is less than a set value (for example, 200 mmHg) and put in closed circuits (on) in the case that it is not less than the set value. The relay 84 is put in a closed circuit during the feed to the glow circuit 83 and in an opened circuit during the non-feed to the glow circuit 83. The temperature switch 87 is put in a closed circuit when the temperature of the engine cooling liquid is less than a set value and in an opened circuit when it is not less than the set value.

At the time of a cold starting of the engine, since the boost pressure is not produced by the compressor 73, both the pressure switches 82, 86 are put in opened circuits. But, since the relay 84 is closed by the feed to the glow circuit 83 as well as the temperature switch 87 is put in a closed circuit by a low temperature of the engine cooling liquid, the electricity is fed to both the coils 77, 78 and the actuation rod 76 is held at the fuel limitation cancelling position Y. Thereby, the control rack 11 becomes movable to the starting position on the left outside and it becomes possible to start the engine vigorously by increasing the fuel injection quantity.

On one hand, at a warm starting of the engine, the respective pressure switches 82, 86 are put in opened circuits because the boost pressure is not yet produced similarly to the above and the relay 84 is opened because the glow circuit 83 is not fed. Further, the temperature switch 87 is put in an opened circuit because the engine cooling liquid is at a high temperature. Therefore, electricity is not fed to both the coils 77, 78 and the actuation rod 76 is changed over to the fuel limiting position X. Accordingly, the control rack 11 can be restrained from moving to the starting position on the left outside and it can be prevented that the excessive fuel is injected into the combustion chamber of the engine. As a result, the black smoke can be prevented from generating at the warm starting of the engine.

Under the low speed operating condition of the engine, since the boost pressure of the compressor 73 does not reach a predetermined pressure yet, the actuation rod 76 is changed over to the fuel limiting position X similarly to the above.

Next, an operation of the engine accelerated under the low speed operating condition will be explained, mainly with reference to FIG. 8. In FIG. 8(A), the alternate long and short dash line N indicates a change of an actual revolution speed of the engine, and the alternate long and two short dashes line K indicates a change of the boost pressure. When the speed control member 39 is manipulated for the acceleration from the low speed revolution range (time t3), similarly to the aforementioned first embodiment, the tension force of the governor spring promptly increases and to the contrary, the increase of the engine revolution speed delays. Therefore, the control rack 11 is apt to be moved to the left side outside the torque-up position by the governor lever. However, the leftward movement of the control rack 11 is prevented by the actuation rod 76 at the fuel limiting position X. Therefore, an excessive fuel can be prevented from being injected with respect to a less quantity of intake air during the time T2 required from the time t3 to the time t4 when the boost pressure reaches the predetermined pressure, so that the generation of the black smoke can be restrained.

On one hand, after the time t4, since both the pressure switches 82, 86 are put in closed circuits and the actuation rod 76 is changed over to the fuel limitation cancelling position Y, the leftward movement of the control rack 11 is allowed.

On the other hand, in the case of the engine with the turbocharger of the second embodiment, the governor lever may be a single lever.

As many different embodiments of the invention will be obvious to those skilled in the art, some of which have been disclosed or referred to herein, it is to be understood that the specific embodiments of the invention as presented herein are intended to be by way of illustration only and are not limiting on the embodiments, changes, or modifications may be made without departing from the spirit and scope of the invention as set forth in the claims appended hereto.

What is claimed is:

1. An improved governor device of a diesel engine having a fuel injection pump and a control rack of said fuel injection pump adapted to be resiliently urged to a fuel increasing side by a governor spring and to be pushed to a fuel decreasing side in response to an input from an engine speed detecting means, wherein a tension force of said governor spring is adjusted by a speed control member, the improvement comprising:

a fuel limiting actuation member, responsive to quick engine acceleration, which operates to prevent an excessive fuel injection;

first means for detecting a selected time lapse; and second means for detecting a position of an engine acceleration control element, coacting with said first means and said fuel limiting actuation member at a fuel limiting position during lapse of a predetermined time at least from the time that a predetermined quick engine acceleration is detected to actuate said fuel limiting actuation member to a fuel limitation cancelling position after lapse of said predetermined time, wherein when a target value for a speed related parameter of the diesel engine exceeds a predetermined low speed range, said second means responds to generate an output to cause movement of the fuel limiting actuation member from said fuel limitation cancelling position to said fuel limiting position during said predetermined time depending on the detection of an excess over said target value, and said second means is mounted in a speed control transmission system so as to make direct contact with said acceleration control element and comprises a limit switch.

2. A governor device as defined in claim 1, wherein:

said control rack is resiliently urged to a fuel increasing position by the governor spring through a fork lever and a spring lever in that order and said control rack is pushed to a fuel decreasing position by an action of the engine revolution speed detecting actuation means through the fork lever, said spring lever is adapted to be received by a fuel limiting pin at a full load position, and said fork lever is resiliently urged to the fuel increasing side by a starting spring.

3. A governor device as defined in claim 1, wherein:

said diesel engine is equipped with a turbocharger.

4. A governor device as defined in claim 1, wherein:

said second means is attached to the speed control member.

5. A governor device as defined in claim 1, wherein:

said output of said second means holds the fuel limiting actuation member at the fuel limiting position during the time required for an actual speed of the diesel engine to exceed the low speed range.

6. An improved governor device of a diesel engine having a fuel injection pump and a control rack of said fuel injection pump adapted to be resiliently urged to a fuel increasing side by a governor spring and to be pushed to a fuel decreasing side in response to an input from an engine revolution speed detecting means, wherein a tension force of said governor spring is adjusted by a speed control member, the improvement comprising:

a fuel limiting actuation member, responsive to quick engine acceleration, which operates to prevent an excessive fuel injection;

first means for detecting a selected time lapse;

second means for detecting a position of an engine acceleration control element, coacting with said fuel limiting actuation member at a fuel limiting position, during lapse of a predetermined time at least from the time that a predetermined quick acceleration is detected, to actuate said fuel limiting actuation member to a fuel limitation cancelling position after lapse of said predetermined time; and a turbocharger comprising a turbine and a compressor driven thereby, wherein said fuel limiting actuation member comprises a solenoid with an actuation rod of the solenoid that is resiliently urged to the fuel limiting position by a biasing force of an advancement spring, the actuation rod being moved to the fuel limitation cancelling position by a force provided by magnetic coils in the solenoid, said second means also comprises pressure switch means for detecting a supercharging pressure of a compressor of the turbocharger to actuate said solenoid, electric power to the solenoid being stopped to thereby advance the actuation rod to the fuel limiting position by the force of the advancement spring when the value of the detected supercharging pressure is less than a set value and electric power being supplied to the solenoid to thereby withdraw the actuation rod to the fuel limitation cancelling position by the force of the magnetic coils when the value of the detected supercharging pressure is not less than the set value; and said second means is mounted in a speed control transmission system so as to make direct contact with said acceleration control element and comprises a limit switch, and wherein when a target value for a speed reluted parameter of the diesel engine exceeds a predetermined low speed range, said second means responds to generate an output to cause movement of the fuel limiting actuation member from said fuel limitation cancelling position to said fuel limiting position during said predetermined time depending on the detection of an excess over said target value.

* * * * *